US007090225B2

(12) United States Patent
Saccomanno et al.

(10) Patent No.: US 7,090,225 B2
(45) Date of Patent: Aug. 15, 2006

(54) WATER-PROOF SEAL FOR A TOWEL BAR WHICH PENETRATES A TUB SURROUND PORTION

(75) Inventors: Mel Saccomanno, Counce, TN (US); David Lester Pinkston, Romulus, MI (US)

(73) Assignee: Aqua Glass Corporation, Adamsville, TN (US)

( * ) Notice: Subject to any disclaimer, the term of this patent is extended or adjusted under 35 U.S.C. 154(b) by 0 days.

(21) Appl. No.: 10/453,209

(22) Filed: Jun. 3, 2003

(65) Prior Publication Data

US 2004/0244104 A1 Dec. 9, 2004

(51) Int. Cl.
*F16L 5/02* (2006.01)

(52) U.S. Cl. ..... 277/607; 277/626; 277/644

(58) Field of Classification Search ..... 277/607, 277/609, 615, 616, 626, 637, 644; 4/577.1, 4/576.1, 611

See application file for complete search history.

(56) References Cited

U.S. PATENT DOCUMENTS 3,979,130 A * 9/1976 Cowie ..... 277/607
4,228,552 A 10/1980 Weaver, Jr.
4,646,491 A 3/1987 Munch
4,818,209 A * 4/1989 Petersson et al. ..... 425/392
4,987,619 A 1/1991 Smith
5,577,275 A * 11/1996 Guenther ..... 4/576.1
5,649,713 A * 7/1997 Ledgerwood ..... 277/615
5,850,640 A 12/1998 Pinciaro
6,036,541 A * 3/2000 Koumatsu ..... 439/587
6,250,044 B1 6/2001 Funk et al.
6,364,121 B1 * 4/2002 Janik et al. ..... 210/438
6,430,759 B1 8/2002 Beltran
6,453,484 B1 9/2002 Pinciaro

* cited by examiner

*Primary Examiner*—William L. Miller
(74) *Attorney, Agent, or Firm*—Carlson, Gaskey & Olds

(57) ABSTRACT

A seal for a bar mounted within a molded tub and surround. The seal includes a flexible flange and a tubular body extending therefrom. The seal provides a plurality of sealing surfaces which operate to engage the bar and aperture such that an effective redundant waterproof seal is provided. The flexible flange is generally perpendicular to the tubular body and is sized to cover any chips or cracks which may exist about the aperture and to accommodate a non-parallel, curved, and/or angled wall portion.

14 Claims, 2 Drawing Sheets

WATER-PROOF SEAL FOR A TOWEL BAR WHICH PENETRATES A TUB SURROUND PORTION

BACKGROUND OF THE INVENTION

The present invention relates to a grommet which provides a waterproof seal for a towel bar which passes through a molded plastic tub surround portion.

Tub surrounds are positioned within a recess built around a bathtub or shower. It is well known to provide a modular tub/shower unit that includes a tub portion at the bottom and two or more wall portions. The whole structure is inserted into the wall recess to form a completely waterproof surround. The fully enclosed waterproof structure is highly advantageous in that it prevents the escape of water into the wall cavity despite the shower spraying water onto the surrounding walls.

One problem that has always arisen with products of this type is that of mounting a towel bar, handrail, or other member which must pierce the surround portions. Piercing the surround portion creates waterproofing difficulties and the potential for damage to the aesthetic surface.

Various styles of conventional grommets and interfaces are known. Each provides particular tradeoffs in complexity, aesthetics, expense, and sealing ability. One particular difficulty is the interface between a tubular part and the curved or angular surface common to the shower surround portions. Oftentimes, a particular waterproof interface must be manufactured for the particular shower surround surface. This may result in an undesirable cost increase to the shower surround or the desire for minimization of components which must pierce the aesthetic surface.

Accordingly, it is desirable to provide a waterproof seal for a molded plastic tub surround which is uncomplicated and aesthetically pleasing while assuring an effective watertight seal.

SUMMARY OF THE INVENTION

The present invention provides a seal for a towel bar mounted within a molded tub and surround. The seal includes a flexible flange and a tubular body extending therefrom.

The seal is manufactured of flexible PVC to provide a plurality of sealing surfaces which engage the bar such that a waterproof seal is provided. The flexible flange is generally perpendicular to the tubular body and is sized to cover any chips or cracks which may exist about the drilled aperture. The flexible flange is further sized to accommodate a non-parallel, curved, and/or angled wall portion.

The present invention therefore provides a waterproof seal for a bar mounted to a molded plastic tub surround which is uncomplicated and aesthetically pleasing while assuring an effective watertight seal.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1:
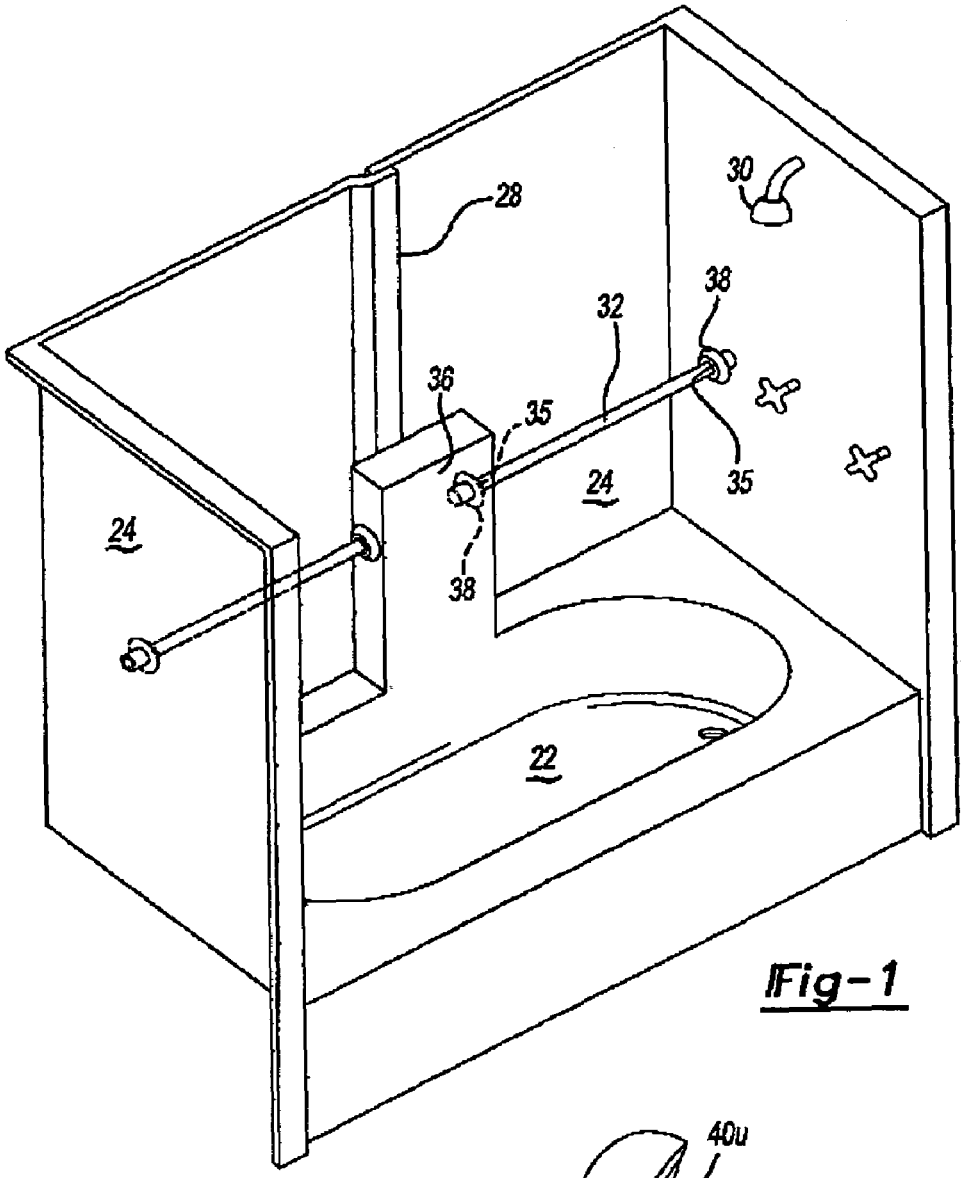
FIG. 1 is a general perspective view of a molded tub and surround according to the present invention.

FIG. 1 illustrates a general perspective view of a molded tub and surround 20 which may be formed of multiple molded portions. In particular, a tub portion 22 receives wall portions 24 and 26 to form the combined tub and surround 20. A joint 28 may be defined between the wall portions 24 and 26. It should be understood that one piece or multi piece portions will also benefit from the present invention. A shower head 30 is preferably mounted through the wall 26 such that water will move in the direction of right to left in FIG. 1.

A bar 32 is preferably located along wall portion 26 within a recess 34 defined therein. The bar 32 may be a towel bar, handrail, or the like. It should be understood that the term "bar" as used herein may further include non-round and shaped bars and non-round shaped components which must be inserted at least partially through the surround 20.

The bar 32 is located through an aperture 35 through wall portions 36 which may not be perpendicular to bar 32. Aperture 35 is typically a drilled hole which may be difficult to achieve without chips around the periphery thereof due to the gelcoat finish of the wall 36. It should be understood that other arrangements will benefit from the present invention and that the illustrated embodiment is but one design. A non-perpendicular arrangement is common to shower surrounds which are typically not rectangular. A seal 38 according to the present invention provides a watertight seal between bar 32 and wall 36 to provide a watertight seal of aperture 35 and cover any chips thereabout. A non-perpendicular arrangement typically results in an elliptical aperture.

Figure 2:
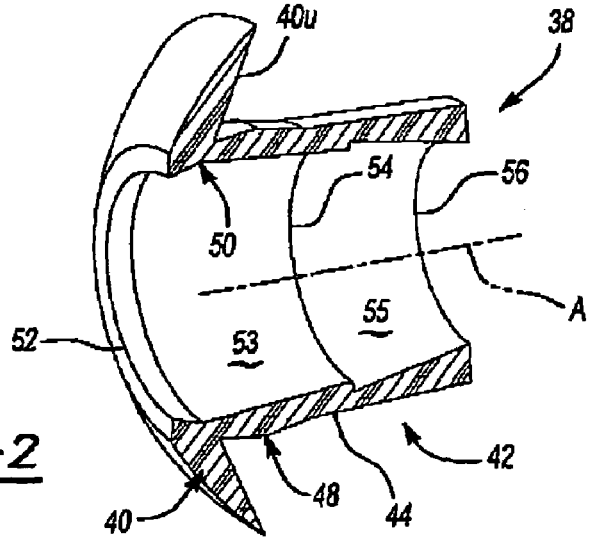
FIG. 2 is a sectional view of a seal according to the present invention taken along a longitudinal axis.

Referring to FIG. 2, the seal 38 is illustrated in a perspective sectional view along a longitudinal axis A. Towel bar 32 or the like is inserted into seal 38 along axis A. The seal 38 includes a flexible flange 40 and a tubular body 42 extending therefrom. The seal 38 is preferably manufactured of a flexible PVC or the like as a generally T-shaped grommet.

The tubular body 42 includes a non-parallel outer surface 44 and inner surface 46. That is, the outer surface 44 and inner surface 46 are not flat cylindrical surfaces but include a plurality of sealing surfaces which operate to engage the bar 32 such that a waterproof seal is provided. The outer surface 44 preferably tapers to a smaller diameter opposite the flexible flange 40 to assist insertion into aperture 35.

The outer surface 44 includes an outer sealing surface 48 adjacent the flexible flange 40. The outer sealing surface 48 is of a greater diameter than the outer surface 44 and is preferably substantially V-shaped in cross section. The outer sealing surface 48 engages the inner surface of aperture 35 (also illustrated in FIG. 3) to provide a watertight line contact seal.

Figure 3:
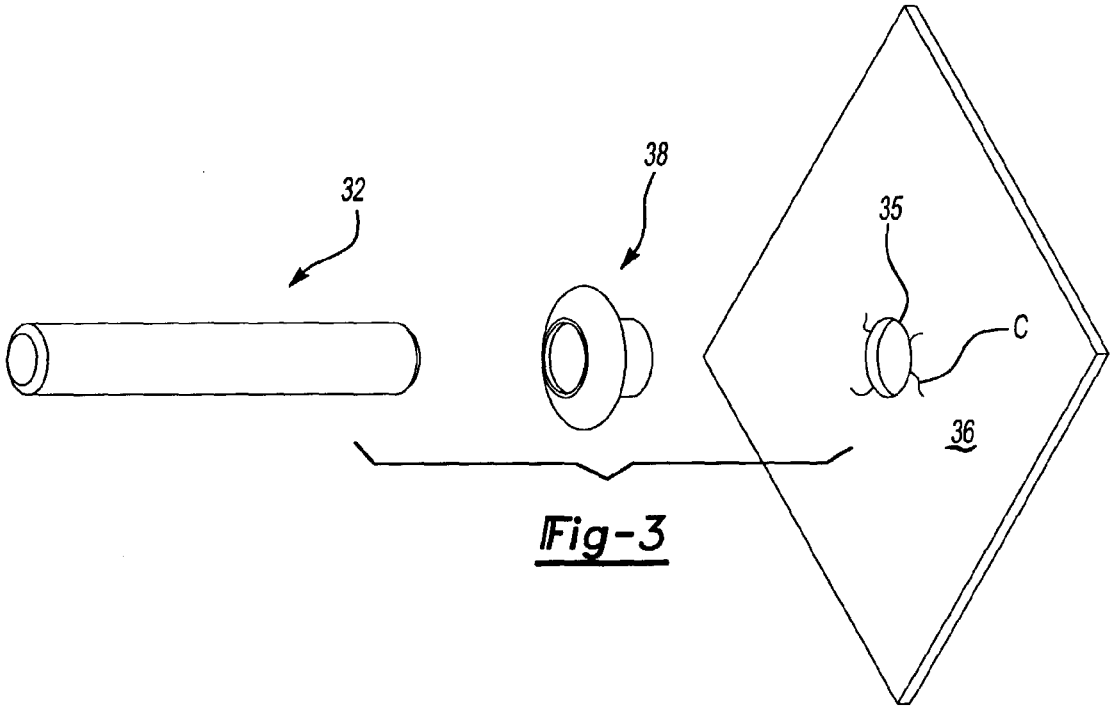
FIG. 3 is an exploded view of a towel bar assembly.
Figure 4:
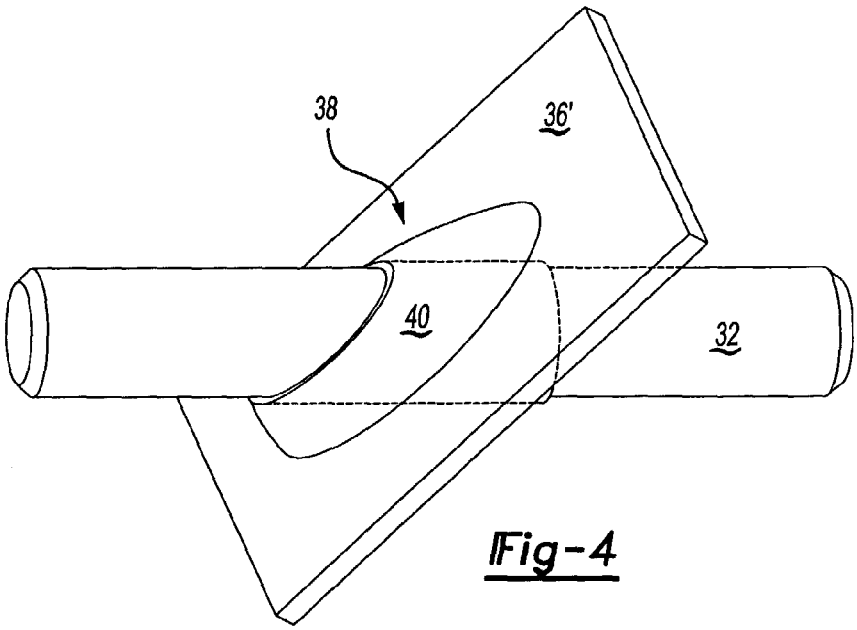
FIG. 4 is a general perspective view of a seal according to the present invention interfacing with a non-perpendicular surround surface.

The flexible flange 40 is generally perpendicular to the tubular body 42. The flexible flange 40 is preferably sized to cover any chips (illustrated schematically at C; FIG. 3) which may exist about aperture 35. The underside 40*u* of the flexible flange 40 also provides a facial sealing surface about aperture 35. The flexible flange 40 is further sized to accommodate a non-parallel, curved, and/or angled wall portion 36' (FIG. 4). That is, the seal 38 may be utilized in numerous different mounting configurations, as various surface interfaces will be accommodated thereby. The wide flexible flange 40 follows the surface to provide a cosmetic interface to conceal a drilled hole while the underside 40*u* thereof provides a sealing surface. It should be understood that the visible surface of flexible flange 40 may be straight, curved, or sloped to provide a desired aesthetic effect.

The inner surface 46 defines a material relief section 50, a first inner sealing surface 52, a second inner sealing surface 54, and a third inner sealing surface 56. The inner sealing surfaces 52, 54, 56 are preferably connected by non-cylindrical surfaces 53, 55 which a progressively smaller diameter relative the flexible flange 40. The non-cylindrical surfaces 53, 55 are essentially frusto-conical portions which define ramps which become radially smaller as the extend away from the flange 40 and toward the inner sealing surfaces 54, 56. That is, the inner sealing surfaces 52, 54, 56 provide redundant waterproof line contacts with the outer diameter of bar 32. The material relief section 50 aft of the first inner sealing surface 52 reduces the resisting forces on the towel bar during assembly.

A lubricant is preferably utilized during assembly to minimize resisting insertion forces on the bar during assembly. The lubricant may also collect within the material relief section 50 during assembly to minimize the lubricant's effect upon surfaces 52, 54, and 56 once assembled.

The foregoing description is exemplary rather than defined by the limitations within. Many modifications and variations of the present invention are possible in light of the above teachings. The preferred embodiments of this invention have been disclosed, however, one of ordinary skill in the art would recognize that certain modifications would come within the scope of this invention. It is, therefore, to be understood that within the scope of the appended claims, the invention may be practiced otherwise than as specifically described. For that reason, the following claims should be studied to determine the true scope and content of this invention.

What is claimed is:

1. A seal for a tub surround portion, comprising:

a flexible flange;

a tubular body extending from said flexible flange to define a longitudinal axis, said flexible flange extending radially outward from said tubular body wherein an underside of said flexible flange comprises a facial sealing surface;

a first inner sealing surface adjacent said flexible flange, a second inner sealing surface, and a third inner sealing surface, said first, second and third inner sealing surface located on an inner surface of said tubular body each defining a substantially waterproof line contact for a member received through said tubular body; and an outer surface of said tubular body deeming an outer sealing surface adjacent said flexible flange, said outer sealing surface of a greater diameter than said outer surface, said first inner sealing surface and said second inner sealing surface are connected by a first non-cylindrical surface non-parallel to said longitudinal axis, said second inner sealing surface and said third inner sealing surface are connected by a second non-cylindrical surface non-parallel to said longitudinal axis, said first and second non-cylindrical surfaces defining frustro-conical portions which extend toward said second and third inner sealing surface, respectively, to form respective waterproof line contacts.

2. The seal as recited in claim 1, wherein said first inner sealing surface, said second inner sealing surface, and said third inner sealing surface provide respectively different inner diameters.

3. The seal as recited in claim 1, wherein said first inner sealing surface, said second inner sealing surface, and said third inner sealing surface define progressively decreasing inner diameters.

4. The seal as recited in claim 1, wherein said flexible flange is substantially perpendicular to said tubular body.

5. The seal as recited in claim 1, wherein said flexible flange is angled toward said tubular body.

6. The seal as recited in claim 1, wherein said outer sealing surface is generally V-shaped in a cross-section taken along the longitudinal axis.

7. The seal as recited in claim 1, wherein said first inner sealing surface is defined adjacent an inner edge of said flexible flange.

8. The seal as recited in claim 1, wherein said flexible flange is generally frusto-conical.

9. The seal as recited in claim 8, wherein said flexible flange is raked toward said tubular body.

10. The seal as recited in claim 1, wherein said first inner sealing surface is substantially V-shaped in a cross-section taken along the longitudinal axis.

11. A seal for a tub surround portion, comprising:

a flexible flange;

a tubular body defining a longitudinal axis, said tubular body substantially perpendicular to said flexible flange, said flexible flange extending radially outward from said tubular body wherein an underside of said flexible flange comprises a facial sealing surface, said tubular body comprises an inner surface and an outer surface, said inner surface comprises a first inner sealing surface adjacent said flexible flange, a second inner sealing surface, and a third inner sealing surface, said first, second and third inner sealing surface each defining a substantially waterproof line contact for a member received through said tubular body; and an outer sealing surface extending about the periphery of said outer surface of said tubular body adjacent said flexible flange, said outer sealing surface of a greater diameter than said outer surface, said second inner sealing surface and said third inner sealing surface define progressively decreasing inner diameters, a first non-cylindrical surface interconnects said first inner sealing surface and said second inner sealing surface, and a second non-cylindrical surface interconnects said second inner sealing surface and said third inner sealing surface, said first and second non-cylindrical surfaces each ramping toward said respective second inner sealing surface and said third inner sealing surface to form said waterproof line contacts.

12. The seal as recited in claim 11, wherein said first inner sealing surface, said second inner sealing surface, and said third inner sealing surface provide respectively different inner diameters.

13. The seal as recited in claim 11, wherein said outer sealing surface is substantially v-shaped in cross-section.

14. A seal for a tub surround portion, comprising:

a flexible flange;

a tubular body extending from said flexible flange to define a longitudinal axis, said flexible flange extending radially outward from said tubular body wherein an underside of said flexible flange comprises a facial sealing surface; and a first inner sealing surface adjacent said flexible flange, said first inner sealing surface defining a generally V-shape in cross-section defined along said longitudinal axis to define a waterproof line contact;

an outer surface defining an outer sealing surface adjacent said flexible flange, said outer sealing surface of a greater diameter than said outer surface; and a second inner sealing surface connected to said first inner sealing surface through a first non-cylindrical surface, and a third inner sealing surface connected to said second inner sealing surface through a second non-cylindrical surface, said first and second non-cylindrical surfaces each ramping toward said respective second inner sealing surface and said third inner sealing surface to form a waterproof line contact.

* * * * *

UNITED STATES PATENT AND TRADEMARK OFFICE

CERTIFICATE OF CORRECTION

PATENT NO. : 7,090,225 B2
APPLICATION NO. : 10/453209
DATED : August 15, 2006
INVENTOR(S) : Saccomanno et al.

It is certified that error appears in the above-identified patent and that said Letters Patent is hereby corrected as shown below:

Claim 1, Column 3, line 55: "deeming" should be --defining--

Signed and Sealed this

Twenty-first Day of November, 2006

JON W. DUDAS
*Director of the United States Patent and Trademark Office*